US006742195B1

(12) United States Patent
Parry

(10) Patent No.: US 6,742,195 B1
(45) Date of Patent: Jun. 1, 2004

(54) CONVENIENCE CHAIR WITH ATTACHABLE TRAY/TABLE AND OPTIONAL ROLL AWAY STORAGE UNIT-SAFE SENIOR UNIT

(76) Inventor: Janet Mary Shirley Parry, 2881 Richmond Road PH8, Ottawa, Ontario (CA), K2B 8J5

( * ) Notice: Subject to any disclaimer, the term of this patent is extended or adjusted under 35 U.S.C. 154(b) by 0 days.

(21) Appl. No.: 10/342,528

(22) Filed: Jan. 16, 2003

(51) Int. Cl.[7] ..... A47K 11/06

(52) U.S. Cl. ..... 4/480; 4/483; 4/239; 4/478; 4/476

(58) Field of Search ..... 4/480, 483, 239, 4/476, 477, 478, 244.1, 244.2, 657, 144.1, 455, 254; 297/188.08, 188.11, 188.12, 188.2, 228, 225

(56) References Cited

U.S. PATENT DOCUMENTS 1,389,940 A * 9/1921 Erbeau ..... 4/239
3,905,051 A * 9/1975 Gozdziewski ..... 4/478
4,785,483 A * 11/1988 Wise ..... 4/478
5,253,375 A * 10/1993 Prosper ..... 4/661
5,359,737 A * 11/1994 Hodge ..... 4/483
5,526,537 A * 6/1996 Conrad ..... 4/483
D471,965 S * 3/2003 Lu Et al. ..... D23/296

* cited by examiner

*Primary Examiner*—Gregory Huson
*Assistant Examiner*—Khoa Huynh

(57) ABSTRACT

A seating apparatus is designed for placing over a standard toilet system. The apparatus includes a chair having a padded backrest, padded arms and a padded seat. A patient accesses the toilet by raising the padded seat that is hinged across the back of the chair. Each of the padded arms includes a plastic side that forms a curved channel on each side of the toilet seat for catching loose items and any possible soil. The apparatus further includes a removable tray/table is mounted on the chair using slots that grip the arms, and a roll-away storage unit that is removably attached to the tray/table or chair.

1 Claim, 8 Drawing Sheets

CONVENIENCE CHAIR WITH ATTACHABLE TRAY/TABLE AND OPTIONAL ROLL AWAY STORAGE UNIT-SAFE SENIOR UNIT

FIELD

This invention is for the medical field. It has been conceived to address a major nursing difficulty. It is designed to facilitate human waste elimination for the large number of patients who are immobilized. It was invented to alleviate a very desparate need of the clients, nurses, attendants and the caregivers (whether in two-income families or not).

The problem is increasing urgently as cuts are being made in all aspects of care, putting the stress on home care of all sorts.

PRIOR ART

In order to obtain assistance for every toilet requirement patients ring bells, or call out continuously until the eventual appearance of an attendant with a commode chair or bed pan (notorious uncomfortable and unstable) plus toilet paper, sanitary pads, etc.

This process soon deteriorates into the use of expensive, disposable diapers, especially at night. These are sometimes rationed three per day in some places, not three per hour which could be necessary for some patients.

To avoid this hopeless situation in-dwelling cathaters are used in both men and women as well as nursing difficulties in both inserting and retaining them, these always carry the risk of infection.

The whole deterioration leads to hours of work on intractable bed sores on sacrem, scrotum heels, etc. and is most troublesome to the patient.

SUMMARY

This invention consists of a comfortable, attractive, reclining armchair with attachments underneath which can secure it over a functioning toilet of any size, height, shape, etc. The patient accesses the toilet by raising the seat which is hinged across the back. A second seat is thereby revealed with a hole an appropriate size and shape to allow for the actual, standard toilet seat to protrude through. The flush mechanism must be easily accessible.

This equipment may be installed over a toilet in an enlarged, adapted bathroom. Or preferably, a new toilet could be installed in a larger room, with adjacent water and waste plumbing, to provide the patient with a pleasant living area . No new seniors residence should be built without the plumbing arrangements accessible for those requiring this type of equipment.

DESCRIPTION OF THE EMBODIMENTS

A. The chair—has soft padded arms, and wings at head level. Attractive, washable slip covers to choice may be obtained and attached with hook and loop.

An distinct detail of this invention is that the inside of the arms are plastic sides which form a curved channel on each side of the seat. This would catch any "accidents" but also catch any pencils, spectacles, etc. which might slip down the sides of the chair.

The patient might wish to simplify their clothing from the waist down to facilitate their use of this equipment.

Reference Numeral in Drawings

1 The standard toilet
2 The standard toilet seat
3 Flush tank or cistern
4 Padded back
5 Wings
6 Padded arms
7 Padded seat
8 Hinge for padded seat
9 Valances
10 Plastic liners
11 Hook and loop
12 Plastic liner channel B. The worktable/tray—This chair requires a worktable/tray with a rail around for the patient to pull themselves up and lean for support. It is attached at one side with a hinge and swings away for easy access. It has a closure on one side of the chair and can be locked into place for security. This is a significant improvement on the current use of makeshift, removablerolling trays which are unstable and provide no support.

Reference Numeral in Drawings

13 Tray/Table
14 Surround rail
15 Area for feet
16 Lock
17 Holder for urinal
18 Compartments located above tray/table
19 Compartments located underneath tray/table
20 Hinge for tray/table
21 Water supply with spigot
22 Toilet flush
23 Kleenex
24 Water holder
25 Slots
26 Cut away portion The work table may be provided with controls or remotes, etc. for radio, tv, audio cassettes, and lights. There would be a space for telephone and water dispenser as well as storage for the urine bottle used by men.

Larger equipment (more suitable for private homes) such as microwave, computer, sewing machine, visual and audio aids could be provided on a role away storage unit. In this way each patient could live safely with the use of his equipment, according to needs and abilities, easily accessible to him and could therefor continue to live as full and active a life as possible.

Reference Numeral in Drawings

27 Roll away storage unit
28 Secured storage for microwave
29 Hook up attachment to chair or tray/table
30 Wide base
31 Wheels
32 Slide out ramp with safe edge Benefits:

As well as vastly alleviating the unpleasantnesses of nursing, it would provide nurses with more time for assisting with any exercise which might be possible. It will also cut down on laundry odour problems, and constant bathing and even the smearing of feces.

Patients alway prefer to remain at home. This equipment would enable the patient to able to manage on their own, safely, at home while family care-givers have to be away e.g. during work hours for the large contingent of lone women supporting both parents and children, though, of course, men are increasingly having to take on these responsibilities as well. This will provide peace of mind for all concerned.

The most important benefit is that of the personal dignity of the patient who can swiftly become exceeding anxious about this most private and necessary of functions, concerned about the access to basic facilities. Particularly, for patients who have a neurogenic bladder who believe they want micturiction every fifteen minutes of so.

The benefits are for all concerned providing the solution to the anxiety, depression and commotion.

DESCRIPTION OF THE DRAWINGS

Description of the Diagrams

FIG. I Side view of Convenience Chair Showing possible angle of reclining back. Padded seat closed. Valance showing plumbing.

Figure 1:
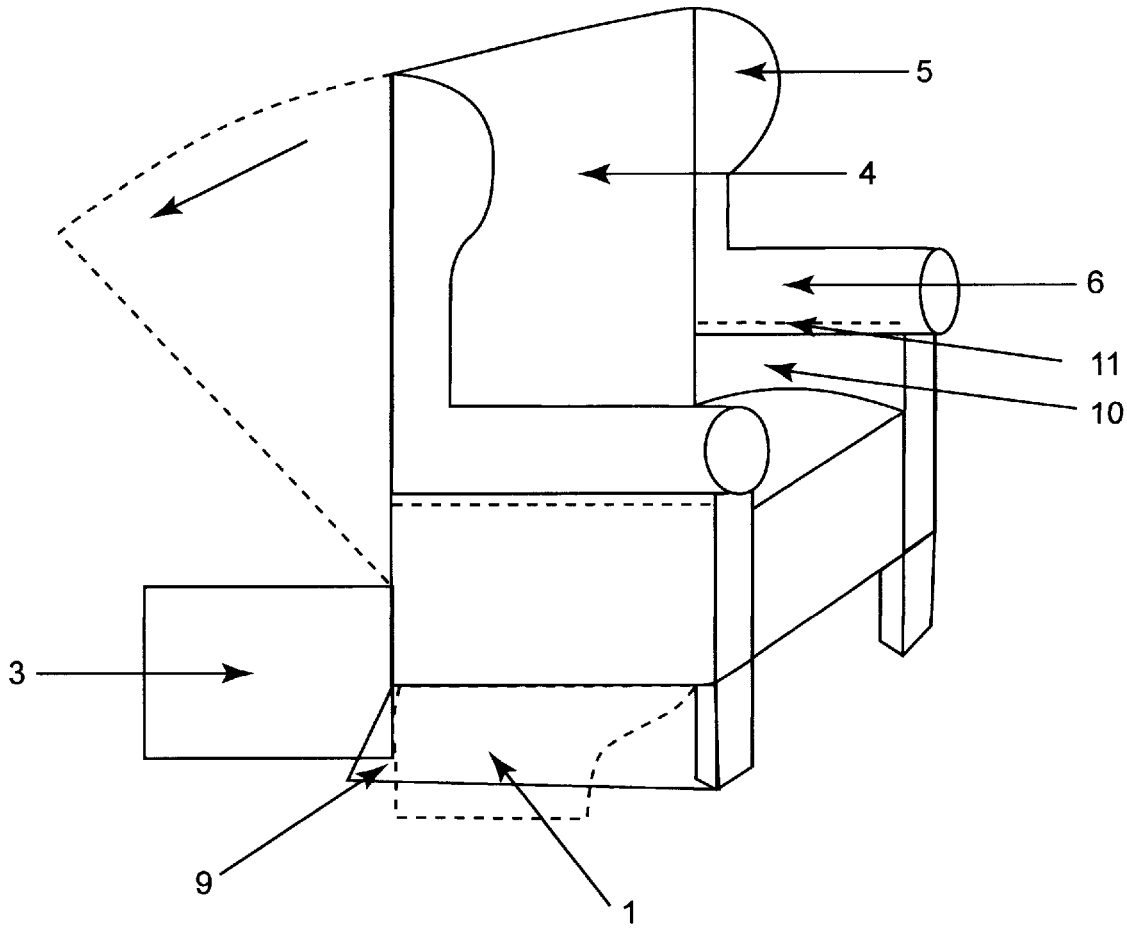
Figure 2:
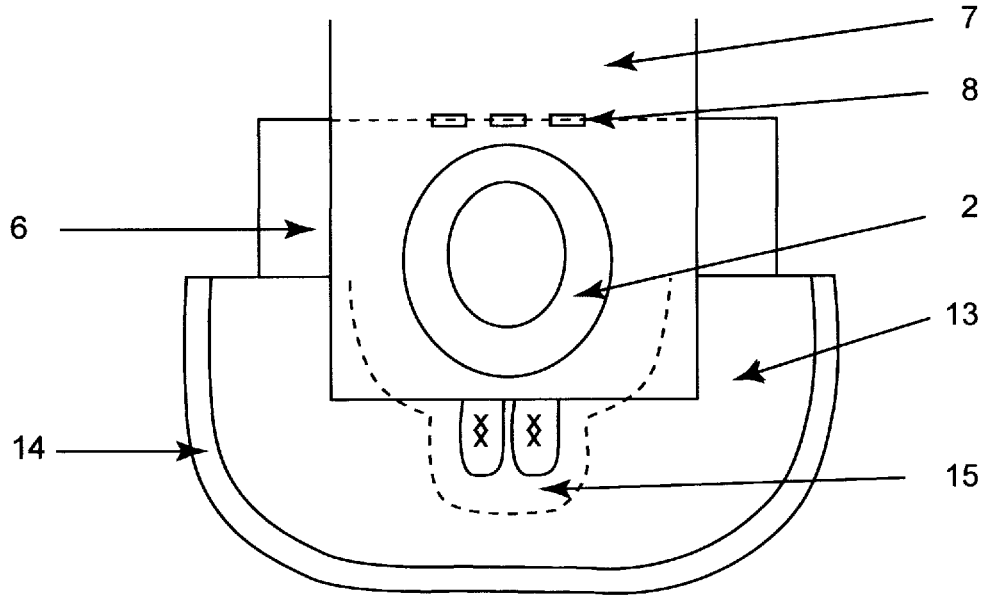
Figure 3:
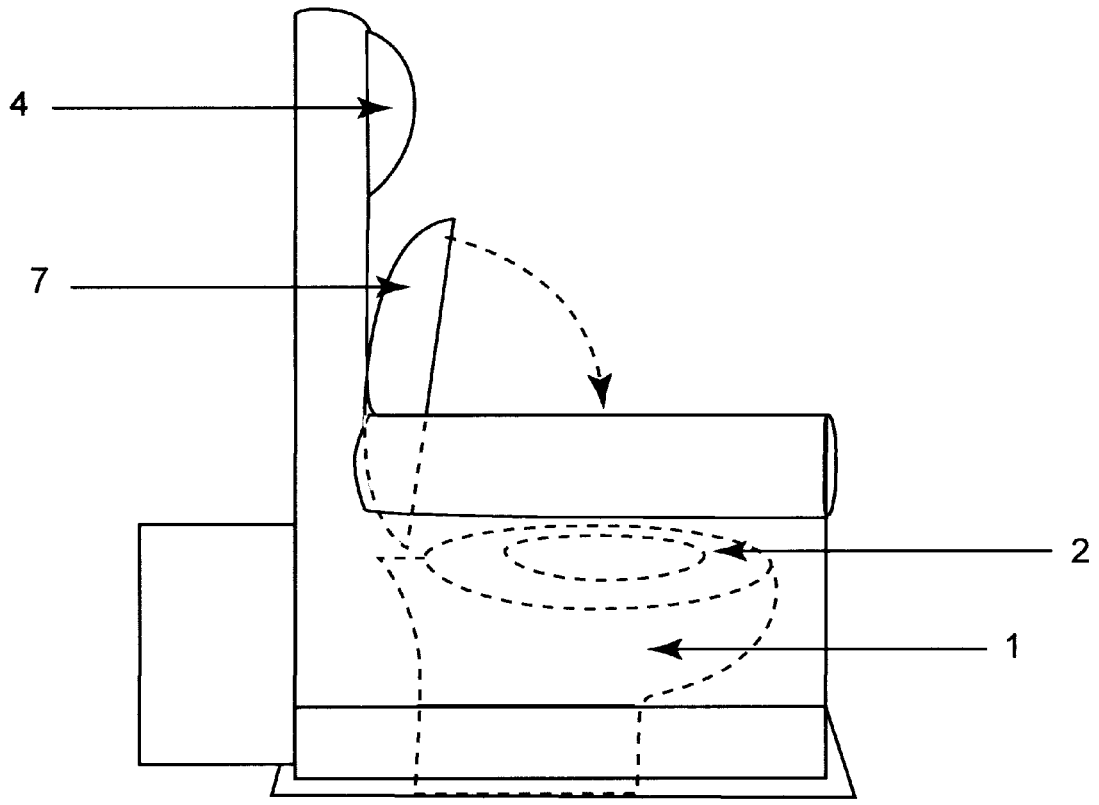
Figure 4:
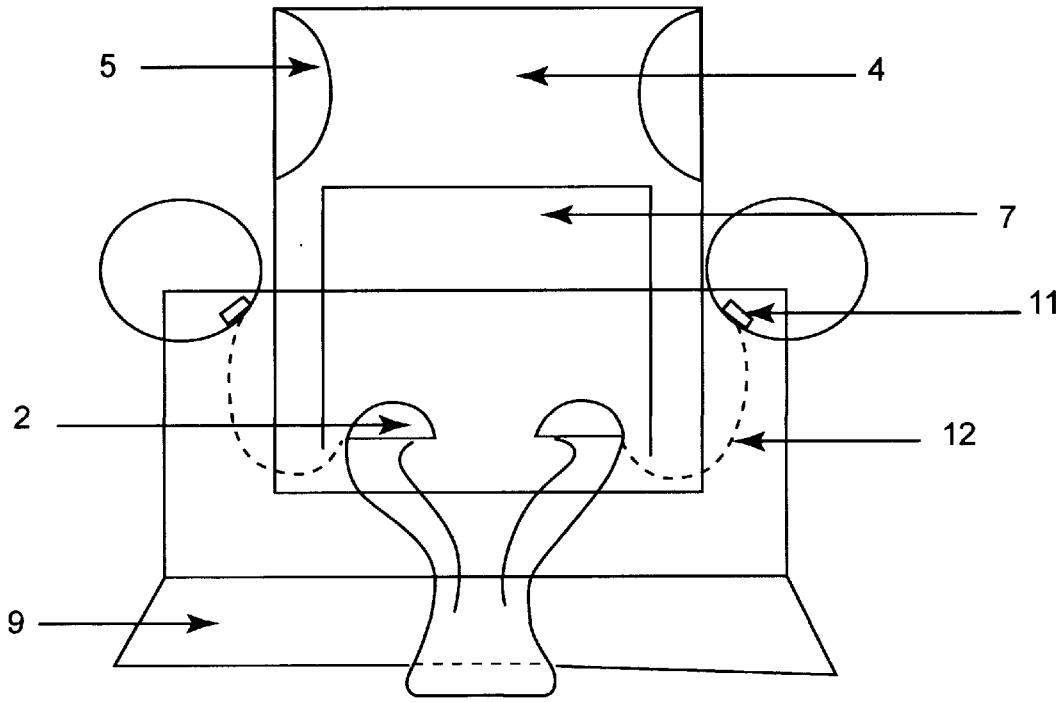
Figure 5:
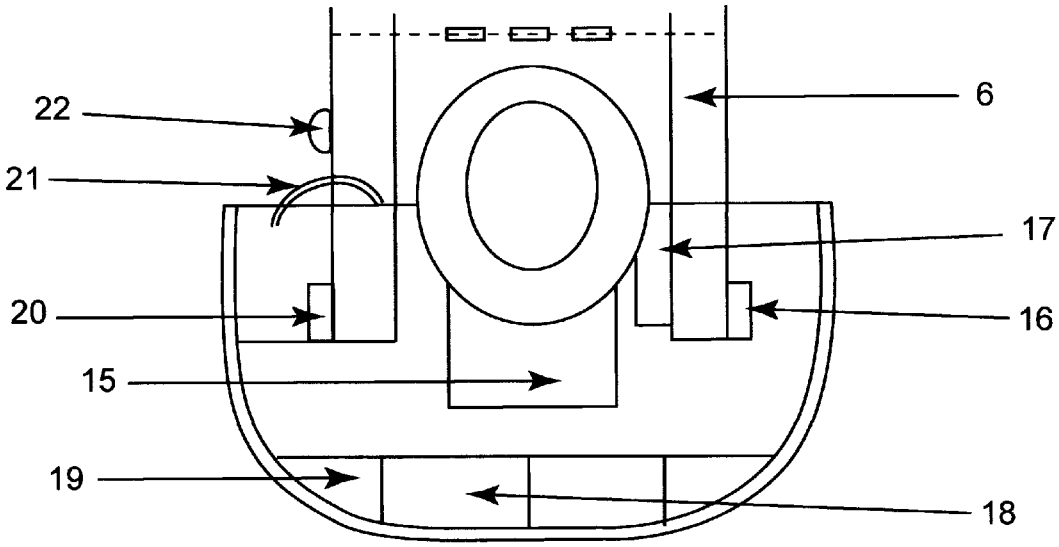
Figure 6:
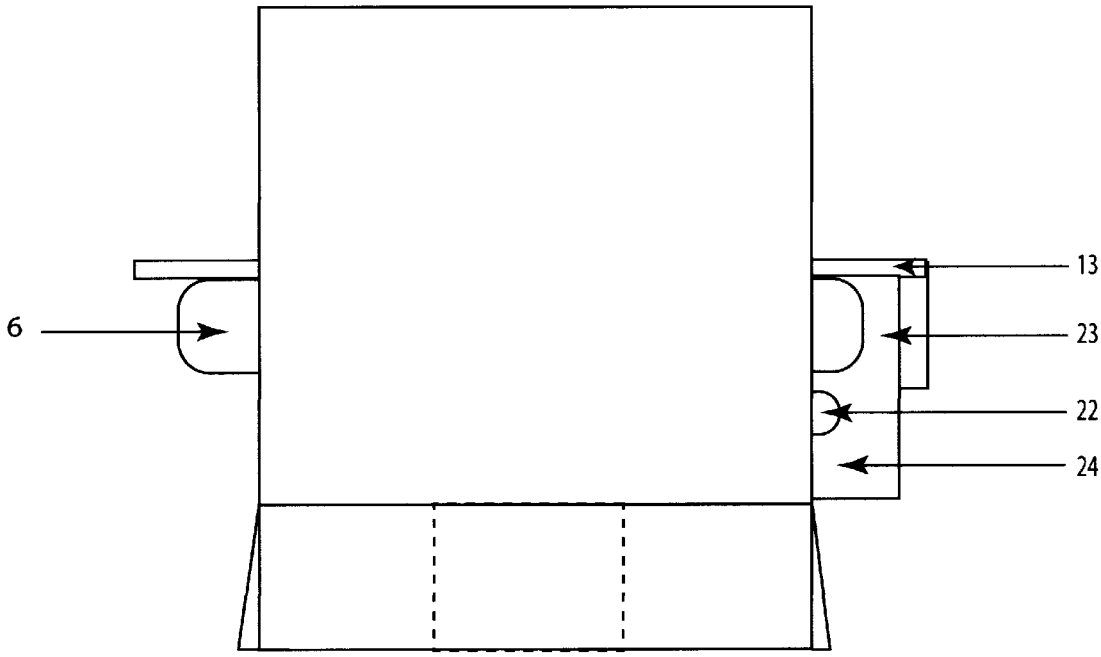
Figure 7:
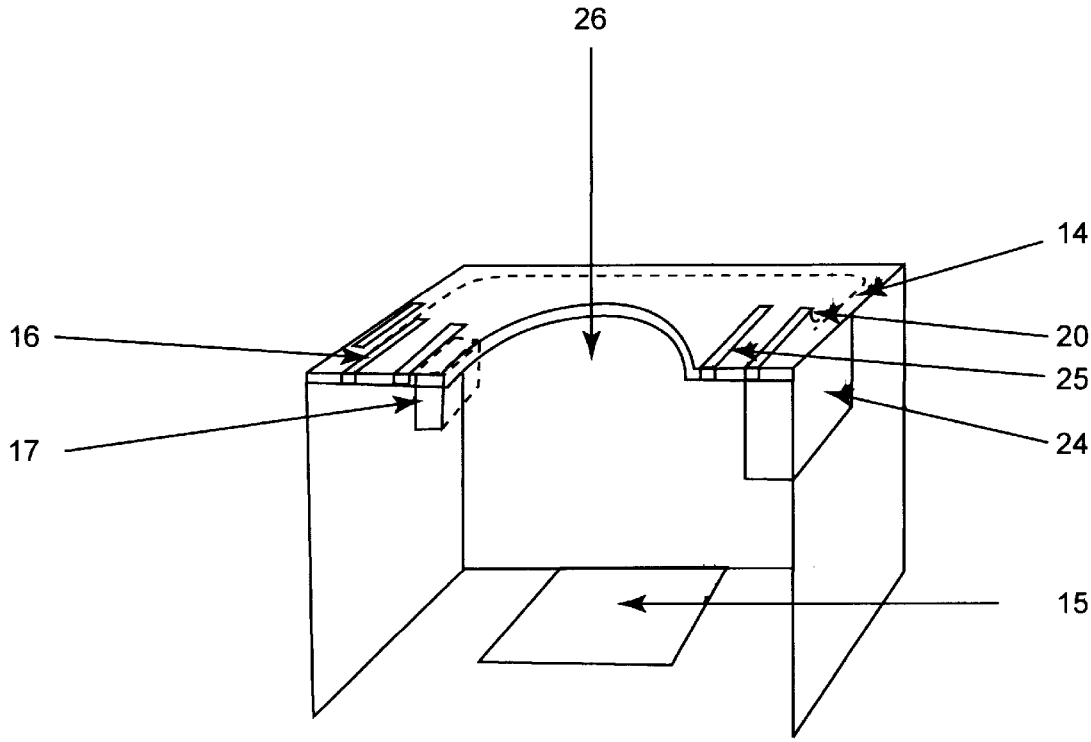
Figure 8:
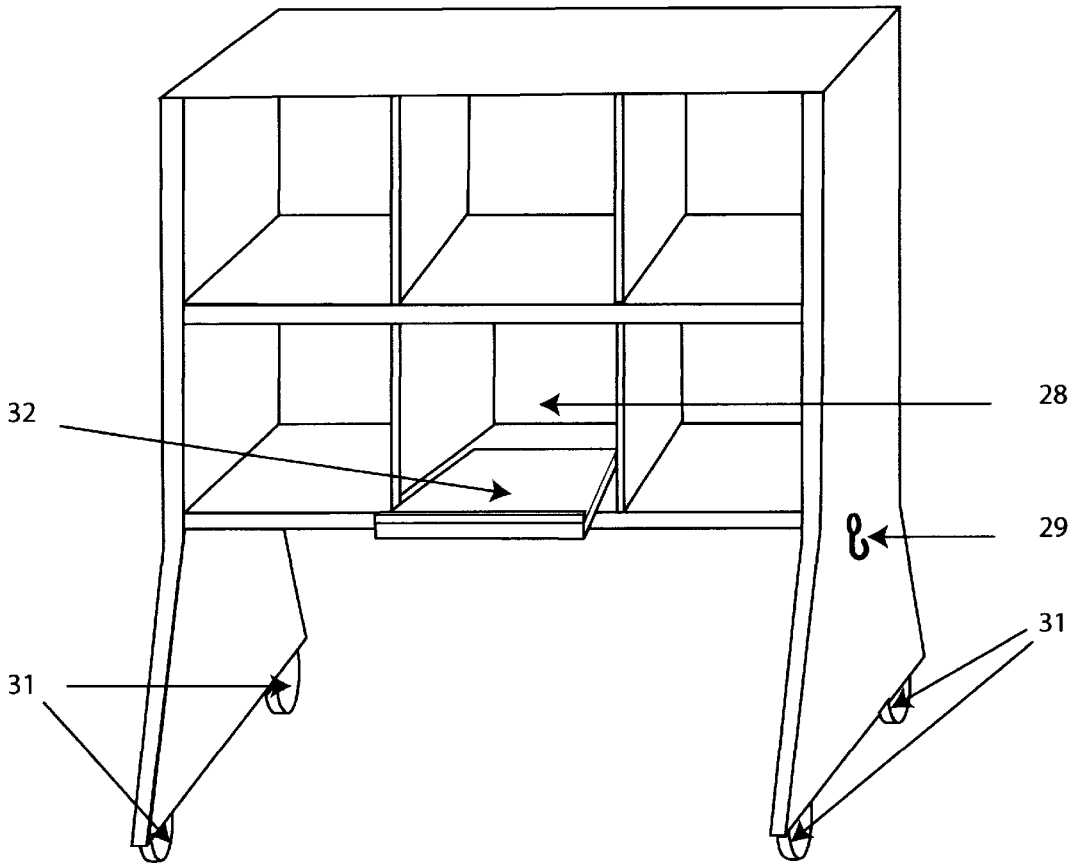

FIG. II Transverse view from above showing padded seat raised, toilet seat protruding, plastic sides forming safety channel. Tray/Table with curved cut away and foot retaining tray.

FIG. III Side view of chair, cross section, padded seat raised and toilet in ready position.

FIG. IV Front view cross section showing chair seat raised, curved plastic safety channel, and toilet.

FIG. V View from above with Tray/Table in position, showing fitments under the tray: container with Spigot, storage for male urinal, Kleenex, also convenient toilet flush button. FIG. VI Cross view of chair back tray in place on arms and view of some fitments.

FIG. VII Transverse view of tray from chair, showing slots for chair arms, water and urinal storage, position of hinge and lock, strong surround rail (for patient to pull themselves up). Cut away on tray for comfort optional tray for stabilizing the feet.

FIG. VIII Front view of roll away storage unit showing wide stable base, with wheels and hook for possible attachment to the Tray/Table. Storage units include safety storage to hold microwave fast, with slide-out safety ramp for unloading hot dishes. These storage units are large for bigger equipment ie. TV, sewing machine, computer, audio visual equipment etc.

PROCEDURE FOR USE

With the vast increase of statistics on seniors including growing numbers of the frail aged-extremely old patients; combined with the lack of available assistants at all levels, facilitating independence, whether alone or institutionalized becomes urgent and vital.

Various Uses—Private: residential or independent under a family roof or with care giver such as: (double earner-sandwich generation family). Client retains dignity i.e. No odour etc.

Residential: it is recommended that all new unites built for seniors should be equipped or at the very least, have provisions for future for installations. The use would range from:

1. Well aged patient who likes to have it near her at night and doesn't need tray.
2. Patient needing help with any transfers away from chair.
3. Fairly immobilized patient sitting all day needing Tray—Table. Probably making some use of the Roll Away Storage Unit.
4. Extremely disabled either mentally or physically but still able to "weight bear" for transfer-organize seat etc. Tray/Table possibly used to restrain.
5. Patients not able to manage alone. The seat would make toiletting infinitely easier for the attendant (Storage Unit with remotes etc might still be useful).
6. Patients in need of a pleasant interesting restraint for their own protection, falling, wandering etc.

Conclusion

The care of the aged is an increasingly urgent need and the quality is deteriorating fast due to mercenary government cut backs. It will very shortly reach crisis proportions due to the baby boomers and the life expectancy of the very aged. In contrast to this there are few young people and they have higher expectations. The morale of all health workers is dropping sharply (over worked and burnout). This is particularly worrying at level of trainee applicants. An ageing work force is more easily injured by lifting it etc. This equipment provides regular use of the legs and extra time for staff to assist with walking.

Most old people do not have families willing or able to abandon their careers for the odious task of catering for the needs and whims of old people. Only 9% of seniors are in institutional care.

The whole problem needs new thought and design and I submit that my Convenience Chair and Safe Senior Unit are the ideal solution and will make home life possible for patient and care giver.

What is claimed is:

1. A seating apparatus in combination with a standard toilet system, said toilet system having a bowl for holding waste, a seat located on the upper rim of said bowl, a water flush tank and a flush mechanism, said seating apparatus comprises:

a chair designed to be placed over said toilet system, said chair having a padded back rest, a pair of padded arms and a hinged padded seat, said padded back rest further includes wings located at the head level of said padded back rest, said back rest provides a resting position for a user, said hinged padded seat is a swing up padded seat which reveals said toilet system, a plastic liner disposed on the inner surface of each of said padded arms, each of said plastic liners curves to form a plastic channel surrounding said toilet seat and catching dropped items and any possible soil;

a removable tray/table mounted on said chair using slots that grip said arms, a strong rail formed around the upper perimeter of said tray/table for supporting the weight of a patient when use to pull up to stand, a plurality of compartments located both above and underneath the tray/table for holding various small accessory items; and a roll away storage unit provided as a safe convenient storage for large items, said roll away storage unit having wide base, a slide out ramp with safe edge and a hook up attachment for attaching said roll away storage unit to said tray/table or chair.

* * * * *